United States Patent [19]

Diggle, Jr. et al.

[11] Patent Number: 4,523,389

[45] Date of Patent: Jun. 18, 1985

[54] APPARATUS FOR DRYING TUBULAR KNITTED FABRIC

[75] Inventors: Edmund A. Diggle, Jr., Oradell; John Krajcovic, Ridgefield Park, both of N.J.

[73] Assignee: Samcoe Holding Corporation, Woodside, N.Y.

[21] Appl. No.: 648,540

[22] Filed: Sep. 10, 1984

Related U.S. Application Data

[62] Division of Ser. No. 489,960, Apr. 29, 1983, Pat. No. 4,484,369.

[51] Int. Cl.[3] ..... F26B 13/08; F26B 13/24

[52] U.S. Cl. ..... 34/105

[58] Field of Search ..... 34/21, 105, 160; 26/74, 26/81; 8/149.1, 149.3, 151; 68/355, 5 D, 5 E, 13 R, 191.1, 20, 22 R, 22 B; 15/306 R, 306 A; 427/173, 176; 118/33, 34

[56] References Cited

U.S. PATENT DOCUMENTS

| | | | |
|---|---|---|---|
| 2,187,644 | 1/1940 | Cohn et al. | 26/81 X |
| 3,207,616 | 9/1965 | Cohn et al. | 68/22 B X |
| 3,412,411 | 11/1968 | Cohn et al. | 8/151 |
| 3,522,719 | 8/1970 | Bruckner | 68/20 |
| 3,688,354 | 9/1972 | Cohn et al. | 26/74 X |
| 4,137,045 | 1/1979 | Brugman | 8/149.1 |

*Primary Examiner*—Philip R. Coe
*Attorney, Agent, or Firm*—Mandeville and Schweitzer

[57] ABSTRACT

The disclosure relates to techniques for high efficiency drying of wet-processed tubular knitted fabric. The wet tubular fabric is initially spread to flat form and then guided in a controlled manner over a so-called Mach nozzle, at which high velocity gaseous medium, usually steam, at speeds approaching the speed of sound and above, is discharged directly through the fabric, which is maintained in tension as it passes over the nozzle outlet. The thus treated tubular knitted fabric, now with a greatly reduced liquid content, is then immediately directed over a second spreader device, which distends the fabric widthwise to a predetermined, uniform width, to restore the fabric width lost during wet processing and during the relatively high tension nozzle treating operation. In this damp, geometrically stabilized condition, the fabric may be directed immediately into an otherwise conventional tensionless dryer for tubular knitted fabric, where the necessary final drying operations are completed. More typically, the fabric is loosely folded and then dried later. Significant production economies are realized pursuant to the invention, both in energy savings and labor savings, as well as reduction in capital equipment costs. The process also makes wet-on-wet foam processing relatively attractive for cetain tubular knitted fabrics.

3 Claims, 5 Drawing Figures

APPARATUS FOR DRYING TUBULAR KNITTED FABRIC

This is a division of application Ser. No. 489,960, filed Apr. 29, 1983, now U.S. Pat. No. 4,484,369.

BACKGROUND AND SUMMARY OF THE INVENTION

Tubular knitted fabric typically is manufactured on circular knitting machines in semi-continuous lengths of tubular fabric. In most cases, the tubular fabric is processed through finishing and even cutting while retained in tubular form. Typically, such processing includes a number of wet processing stages, such as washing, bleaching, sometimes dyeing, etc. At the end of this wet processing stage, the fabric is dried and prepared for finishing.

In a typical conventional wet processing line for tubular knitted fabric, the semi-continuous tubular fabric, at the end of the wet processing stage, is directed over an internal spreader device, which is designed to restore the fabric width to some desirable and appropriate dimension. In this respect, it will be understood that knitted fabric is inherently unstable geometrically (as distinguished from woven fabric, which is rather stable), and typically becomes substantially elongated in length and reduced in width, by reason of the lengthwise tensions applied to the fabric during wet processing. After passing over the spreader, the fabric conventionally goes through extractor rolls, in the form of one or more opposed sets of resilient nip rollers. These serve to physically displace water from the fabric, typically reducing the percentage of water to, say, 85% (meaning 85 pounds of water per 100 pounds of dry fabric). Typically, the fabric is then treated in a tensionless dryer, which usually is either steam heated or direct fired with gas. A typical dryer apparatus for this purpose is shown in the Frezza U.S. Pat. No. 3,496,647.

With conventional practices, in a two drum dryer of the type shown in the before mentioned U.S. Pat. No. 3,496,647, there may be a maximum drying capacity of approximately 350 pounds of water per hour. In the more economical dryer units, particularly the direct fired units, the drying costs at current energy cost levels typically are on the order of 1.5 cents per pound of water removed.

Pursuant to the present invention, significant economies are realized by utilizing in advance of the conventional dryer apparatus a so-called Mach nozzle, particularly of the type described and claimed in the Brugman U.S. Pat. No. 4,137,045. The nozzle is arranged to act on the tubular knitted fabric in advance of the dryer and serves to remove a substantial portion of the liquid content of the fabric before the fabric enters the dryer. The nozzle treatment serves to reduce the liquid content of the fabric well below the 85% level, achievable with conventional roller extraction, typically, to under 50%, thus greatly reducing the workload on the dryer for a given amount of fabric. With the nozzle treatment according to the invention, energy costs per pound of water removed are significantly less than with conventional drying arrangements. Accordingly, significant overall production cost savings are achieved. In addition, since a given amount of fabric has significantly less water to be removed by the dryer, the operating rate of the entire processing line, which tends to be limited by the dryer capacity, can be greatly increased.

The theoretical advantages of the so-called Mach nozzle system are well known from the disclosure of the Brugman U.S. Pat. No. 4,137,045, which even suggests it applicability to knitted fabrics. Nevertheless, it has been conventional wisdom that the Mach nozzle procedures could not be employed with knitted fabrics, at least tubular knitted fabrics, because of the high distortability of such fabrics and the need for maintaining the fabric under significant tension during penetration of the fabric by the high velocity steam jet. Thus, while the patent itself states that the processing of knit wear can be accomplished, the wisdom of people skilled in the art, has been that such processing could not in fact be carried out, at least on a basis that would enable a commercially acceptable product to be realized at a commercially acceptable cost basis.

In accordance with the present invention, a novel procedure and apparatus is provided, which indeed does enable tubular knitted fabric to be effectively processed and dried, using a Mach nozzle treatment stage in advance of a tensionless dryer.

Pursuant to one aspect of the invention, wet processed fabric may be taken directly from a truck or similar container and is spread to flat form and predetermined width while still in wet form. The wet, spread fabric is then discharged directly into a resilient control nip, comprising a pair of opposed resilient rollers. From this roller pair, sometimes referred to as entry-side rollers, the fabric is guided downward and around the high velocity nozzle and then upwardly to an exit-side pair of resilient rollers. According to one aspect of the invention, the respective pairs of rollers make very light contact with the fabric, so as not to crease the fabric edges, but sufficient, nevertheless, together with the degree of wrap-around of the fabric about the lower rollers, to provide relatively positive control over the movement of the fabric.

In typical mill practice, pre-drying extraction operations are usually carried out on an off-line basis from the dryer proper, because such operations can be performed at much greater rates of speed than the rate of operation of a typical dryer. Thus, the extraction equipment may service more than one dryer, and, in many cases multiple strings of tubular knitted fabric are run side by side through the dryer. Nevertheless, it is contemplated by the invention that the fabric may be processed by the Mach nozzle section on an in-line basis with the dryer, perhaps with a plurality of nozzle sections feeding two or more webs to a single dryer.

The procedures and apparatus of the invention make it possible, contrary to conventional wisdom, to process highly distortable tubular knitted fabric by means of the Mach nozzle system, and enable very significant economies in energy costs to be realized, as well as significant increases in processing speed with concomitant reduction in labor costs per production unit.

The procedures of the invention are additionally advantageous with respect to the application of wet-on-wet foam processing. In general, the use of foam-based chemicals in the processing of fabrics is advantageous because the lower liquid content of the foam-based chemicals reduces subsequent drying costs. However, the application of foam-based chemicals to wet processed fabric has not, under conventional practices, enabled consequential savings to be realized because of the high residual content of the incoming fabric. Pursuant to the present invention, however, the liquid level of the incoming fabric is sufficiently low that the low moisture content of the foam-based chemicals results in a meaningfully low total liquid content after foam processing.

For a better understanding of the above and other features and advantages of the invention, reference should be made to the following detailed description of a preferred embodiment of the invention and to the accompanying drawings.

DESCRIPTION OF A PREFERRED EMBODIMENT

Figure 1:
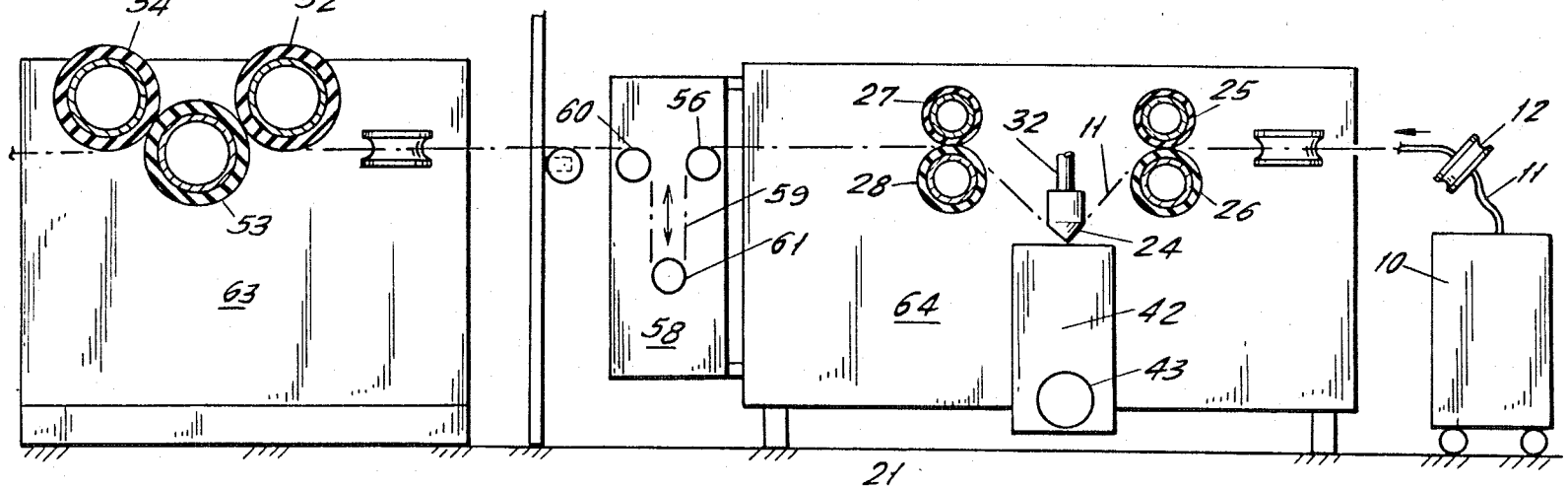
FIG. 1 is a simplified, partially schematic side elevational view illustrating a processing system for tubular knitted fabric, including Mach nozzle system for preliminary extraction, to be followed by folding and subsequent off-line drying or immediately by in-line drying.
Figure 3:
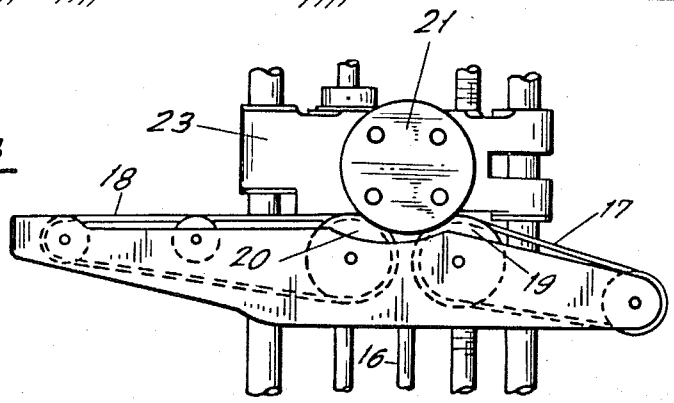
FIG. 3 is a fragmentary illustration of a fabric spreader apparatus as utilized in the system of the invention.

Referring now to the drawings, and initially to FIG. 1, the reference numeral 10 designates a truck or other container, usuaally on wheels, for containing a length of wet processed tubular knitted fabric, which is ready for detwisting, wet spreading and extracting, in preparation for drying. The fabric 11 typically is drawn upwardly, through an eye guide 12 and onto the forward end of an adjustable width spreader 13 which may, by way of example only, be of the type shown in the S. Cohn et al. U.S. Pat. No. 3,207,616, the Frezza U.S. Pat. No. 3,875,624, or the Frezza U.S. Pat. No. 4,103,402, incorporated by reference, all owned by Samcoe Holding Corporation of Woodside, N.Y. In accordance with known practices, the spreader, generally designated by the numeral 13, is comprised of opposed, spaced belt frames 14, 15, connected by an adjustable length bar 16. As reflected in FIG. 3, the illustrated form of belt frames contain entry side and exit side belts 17, 18 respectively. Adjacent drive sheaves 19, 20 for the respective belts are engaged, supported and driven by rotatable edge drive rolls 21, 22 at opposite sides of the machine. The edge drive rolls are mounted on carriages 23 which are movable toward and away from the center line of the processing equipment, in accordance with known practices, in order to support and drive the fabric spreaders of various predetermined width settings.

Immediately downstream of the spreader 13, in the direction of fabric travel, is a water (liquid) removal apparatus which, in part, comprises a so-called Mach nozzle 24, substantially as described and claimed in the Brugman U.S. Pat. No. 4,137,045, incorporated herein by reference. On each side of the nozzle, upstream and downstream thereof, is a pair of fabric driving and control rolls. Rolls 25, 26 are located on the entry side of the nozzle and rolls 27, 28 are located on the exit or discharge side of the nozzle.

Pursuant to the invention, the upper rolls 25, 27 of each of the roll pairs straddling the Mach nozzle are not loaded, in the sense of being urged downward toward the corresponding lower rolls by springs, airloading devices, weights, or the like. To the contrary, the upper rolls are desirably relatively light in weight, and are loosely supported above their respective lower rolls, as for example by means of loose vertical guide slots or the like (not shown).

Figure 2:
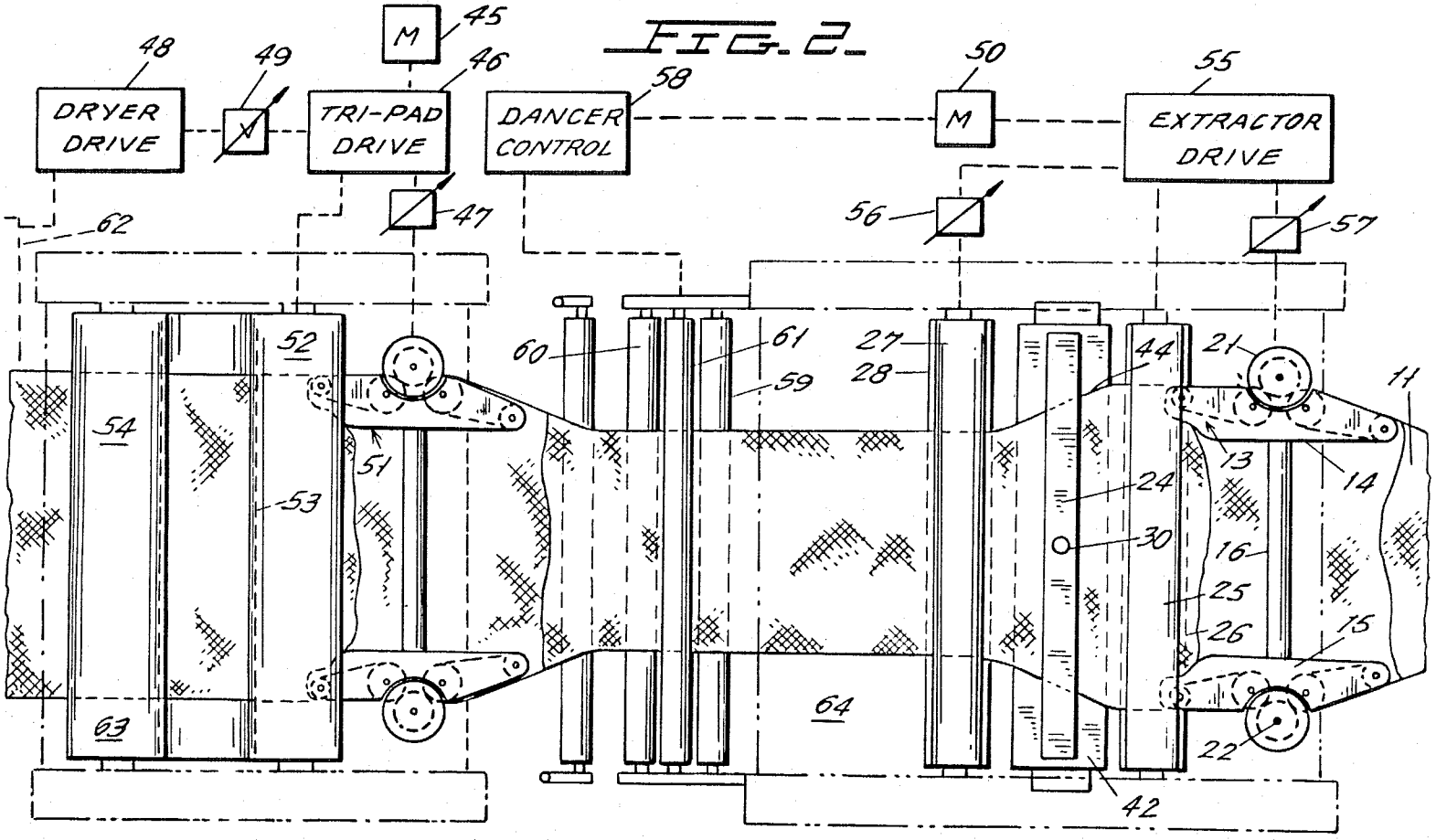
FIG. 2 is a simplified, partially schematic top plan view of the system of FIG. 1.

As illustrated in FIG. 2, the first stage spreading device 13 discharges the spread, wet fabric directly into the first roll pair 25, 26. Uncharacteristically, although the fabric at this stage is thoroughly wet from the prior wet processing operations, the roll pair 25, 26 is not required to perform any significant liquid extracting function. In this respect, while there is no advantage in continued retention of liquid past the first roll stage, there is, on the other hand, no advantage in removing any of it at that stage, because the operation of the Mach nozzle 24 is not significantly affected by the presence or absence of the amount of liquid that could be expressed by the first roll pair. On the other hand, the loading forces necessary to achieve expression of significantly liquid at the first roll pair would result in increased power consumption, reduced roll life, and possibly some fabric distortion resulting from the squeezing action of the rolls. It has been found that, by providing the rolls with resilient coverings, which have good gripping action on the fabric, the roll pairs 25, 26 and 27, 28 can serve their principal function of controllably and adjustably advancing the forward movement of the fabric, using relatively lightweight upper rolls without any external loading.

In accordance with the teachings of the Brugman U.S. Pat. No. 4,137,045, liquid removal from the fabric 11 is effected by passing the fabric around and in contact with a wedge-shaped nozzle having a wedge angle of 60° to 90° and having a somewhat rounded lower edge provided with a transverse slit for the discharge of high velocity gaseous drying medium, typically, in this case, steam. As reflected in FIG. 1, the nozzle 24 is positioned below the plane of the roller pairs, so as to cause the fabric 11 to be diverted downward, around the nozzle, and back up to the exit side roller pair. The fabric thus forms a V-like trough and is in intimate contact with the wedge-like surfaces of the nozzle from which the high velocity steam is ejected.

Figure 5:
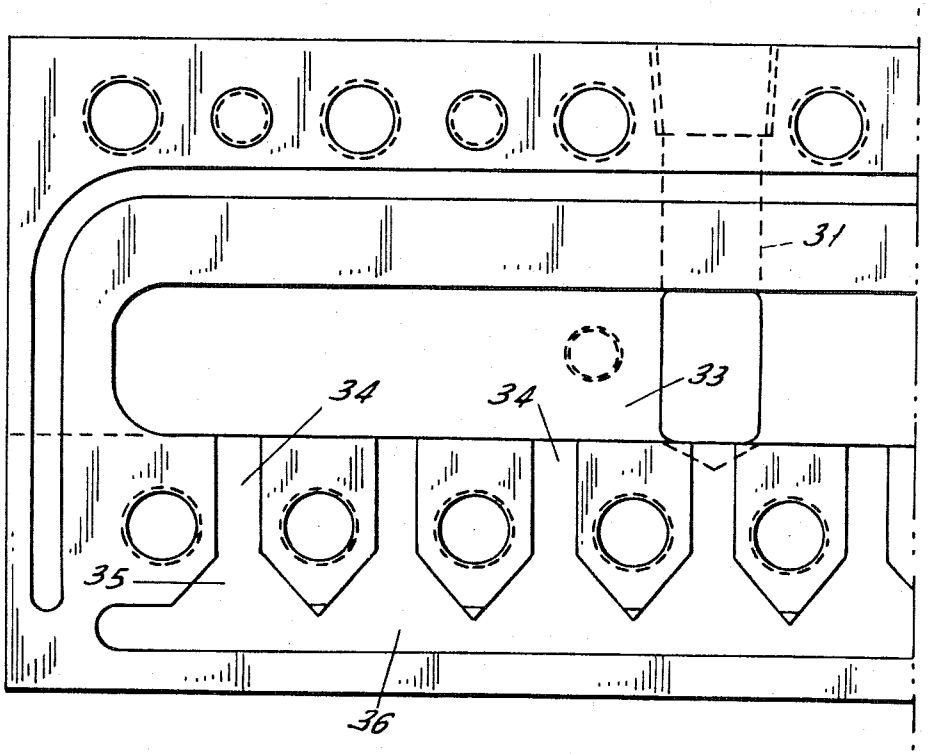
FIGS. 4 and 5 are end elevational and longitudinal cross sectional views respectively of a high velocity steam discharge nozzle as used in the process of the invention.
Figure 4:
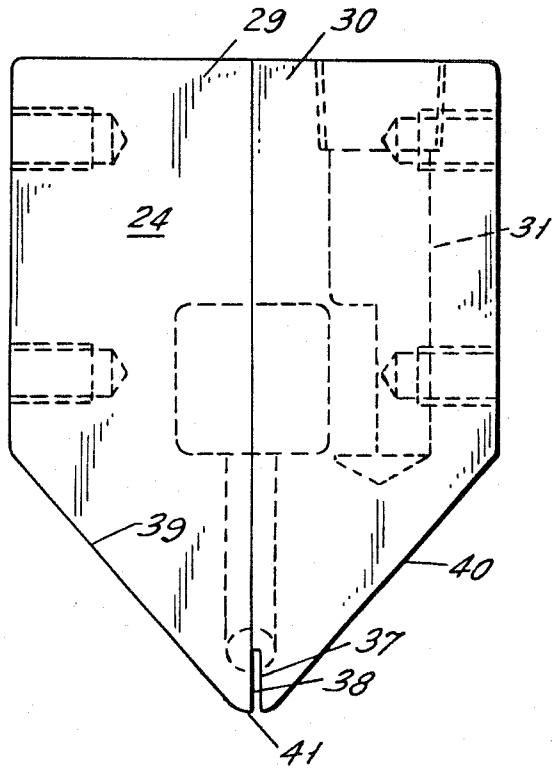

FIGS. 4 and 5 illustrate end elevational and fragmentary cross sectional views respectively of the high velocity nozzle 24 according to the before mentioned Brugman patent, which is utilized in the process and apparatus of the invention. Typically, the nozzle consists of two half sections 29, 30, of more or less symmetrical configuration, arranged to be bolted together in the manner reflected in FIG. 4. An inlet passage 31 is formed in one of the sections 30 and is arranged for connection to a pipe 32 (FIG. 1) leading to an appropriate source of steam under pressure. The passage 31 discharges into a horizontally elongated manifold cavity 33, which extends over substantially the full width of the nozzle, being closed at each end. A plurality of distribution passages 34 lead downwardly from the manifold cavity and diverge at 35 into a secondary manifold cavity 36, which also extends along substantially the full width of the nozzle. A narrow slot forming recess 37 is machined in one or both of the nozzle sections, to define a transversely extending narrow discharge slot 38. The size and configuration of the slot is, in accordance with the teachings of the Brugman patent, such as to provide for the discharge of the gaseous treating medium, typically steam, at extremely high velocity, approximating the speed of sound.

The wedge-like lower surfaces 39, 40 of the assembled nozzle halves, form an included angle of 60° to 90° and are desirably smoothly polished in order to accommodate the movement thereover of fabric being treated. The lower extremity of the nozzle is rounded, as at 41, to allow for the relatively abrupt change in direction of the fabric without abrasion or damage.

Desirably, a steam recovery chamber 42 is provided under the nozzle 24. The chamber leads to an exhaust duct 43, by which excess steam is vented off.

In accordance with one aspect of the invention, the tubular knitted fabric being processed by the high velocity steam nozzle 24 is unsupported, that is, it is neither conveyed by nor supported from below by a secondary carrier web. Rather, it is held in tension contact with the high velocity nozzle by reason of lengthwise tension in the fabric itself. Of course, as will be appreciated, the wet fabric being discharged from the first stage spreader 13 is highly dimensionally unstable and, when placed under the tension necessary to maintain working contact with the high velocity nozzle 24, both elongates significantly (e.g., fifteen percent in a typical case) and correspondingly narrows in width, as reflected at 44 in FIG. 2. To this end, the respective entry side and exit side roll pairs are adjustably synchronized by way of a variable speed drive 56 (P.I.V.) such that the speed of operation of the exit side rolls can be adjusted to be appropriately higher than the speed of operation of the entry side rolls. This can be adjusted as a function of visual observations of the machine operator such that proper tension is maintained in the fabric without, on the other hand, excessively distorting it. This is a matter of empirical determination in each case, depending on the specifics of the fabric construction, but is an adjustment easily carried out by an operator of even modest capability.

Fabric leaving the high velocity nozzle 24 and the exit side roll pair 27, 28, is greatly reduced in liquid content. Typically, the liquid content of the nozzle-processed fabric may be on the order of 50% (i.e., 50 pounds of water per 100 pounds of dry fabric), whereas fabric subjected to roller expressing according to prior art techniques would more typically have a water content of 85% (i.e., some 70% greater liquid content than after nozzle processing).

In accordance with the invention, immediately following liquid removal by nozzle processing, the now-damp fabric is distended to a predetermined uniform width, approximating desired finished width, by way of a second stage belt spreader device 51 which may, for example, be of the same construction as the first stage spreader 13. In a typical case, the second stage spreader 51 may be integrated directly into the nozzle processing unit, and this is of course contemplated by the disclosure. In the specific system illustrated, however, a multi-purpose system is provided, in which the second stage spreader forms part of a so-called Tri-Pad unit, such as illustrated in the S. Cohn et al. U.S. Pat. No. 3,207,616. In the illustrated system, the second stage spreader 51 discharges onto a set of rolls of inverted triangular configuration. If no further processing of the fabric is desired, it merely travels over the surfaces of synchronously driven processing rolls 52, 53, 54, without nip pressure being applied, but with the fabric being geometrically stabilized by contact with the roller surfaces. Fabric leaving the processing roller 54 may be directed into a tensionless dryer unit 62 of the type illustrated in, for example, the S. Cohn et al. U.S. Pat. No. 3,207,616 or the beforementioned Frezza U.S. Pat. No. 3,496,647).

In the illustrated form of the invention, the controlling drive for the processing line is a variable speed motor 45 which, through a drive mechanism 46, is directly connected to the rollers 52–54 of the Tri-Pad unit. The second stage spreader unit 51, forming part of the Tri-Pad apparatus, is driven off of the main Tri-Pad drive 46 through a variable speed pulley or the like 47, such that a range of speed adjustment of the spreader relative to the rolls of the Tri-Pad is possible. Most typically, this is adjusted to provide for a slight degree of overfeeding of the fabric by the spreader 51 to assure tensionless conditions in passing over the Tri-Pad rolls. A drive 48, for the dryer unit 62, is driven off of the Tri-Pad drive 46 through a P.I.V. or similar variable speed drive 49, such that the speed of the dryer may be adjusted to be slightly less than the operating speed of the Tri-Pad rolls, again for the purpose of maintaining tension free conditions for the fabric 11.

The extractor section, consisting of the first stage spreader 13, roll pairs 25, 26 and 27, 28, and the high velocity nozzle 24, advantageously may be independently driven by a second variable speed motor 50. However, the operation of the extractor unit is controlled to follow automatically the operation of the Tri-Pad unit, by means of a dancer control unit 58. As reflected in FIG. 1, there is positioned between the Tri-Pad unit, generally designated by the reference numeral 63, and the extractor unit, generally designated by the numeral 64, a pair of guide rolls 56, 60 and a vertically movable dancer roll 61, all forming part of the dancer control 58. The speed of the extractor unit motor 50 is controlled by the position of the vertically movable dancer roll 61 in accordance with known control techniques. Thus, to the extent that the speed of operation of the extractor unit tends to lag that of the Tri-Pad unit, the dancer roll 61 will be elevated by the progressively shortening loop 59 of fabric passing around the dancer roll. In response, the speed of operation of the motor 50 is increased proportionately, such that, on the average, the dancer roll 61 seeks a predetermined average elevation and, in doing so, enables the speed of the extractor unit 64 to closely track that of the Tri-Pad unit.

As reflected in FIG. 2, the extractor unit motor operates through an extractor drive 55 to drive directly the lower roll 26 of the entry side roll pair. The lower roll 28 of the exit side pair is driven off of the extractor drive 55 through a variable speed P.I.V. unit 56, which provides for the exit side pair to be driven at a somewhat higher rate of speed than the entry side pair, enabling the fabric to be elongated sufficiently to maintain desired levels of lengthwise tension in the fabric. The first stage preader unit 13 is also driven off of the extractor drive 55, through a variable speed pulley system 57 or the like, such that the speed of the spreader unit may be varied slightly with respect to that of the entry side roll pair. Typically, there might be a slight overfeeding of the fabric from the spreader unit 13.

As will be evident in FIG. 2, there is a substantially enlargement of fabric width as the fabric enters the second stage spreader 51. To accommodate this enlargement in width, the average speed of advancement of the fabric in the Tri-Pad stage is considerably less than the average speed of advancement of the elongated fabric being discharged from the exit side roll pair 27, 28 of the extractor unit. This, however, presents no problem, inasmuch as the dancer control 58, by maintaining a predetermined average loop 59 of fabric, automatically compensates for any width variations in the fabric and resulting differences in the speed of advancement of the fabric.

Important theoretical advantages accrue where the tubular knitted fabric, after second stage spreading, can be directed immediately into the dryer for completion of the drying operation. This results in part from the fact that the fabric, immediately after nozzle processing, is very hot, virtually at the temperature level for the commencement of drying, such that additional energy savings and increased operating speeds may be realized in the dryer. On the other hand, the speed of operation of the nozzle processing unit typically is much greater than the maximum operating speed of a typical commercial tensionless dryer. As a result, many processors find it to be more economical to fold the damp fabric as it emerges from the second stage spreading operation, transport the folded fabric to a dryer at another location, and feed the dryer from the supply of folded fabric. By way of the last described procedure, a nozzle processing unit, operating at speeds significantly greater than that of the dryer, can supply fabric to several dryers and/or supply several strings or webs of fabric to a given dryer. In this respect, it is quite common for dryers to process multiple webs side by side to increase overall throughput of fabric even though operating at relatively slow linear speeds of advance.

Folders suitable for the purposes hereof are reflected in the Eugene Cohn et al. U.S. Pat. No. 2,761,678 and/or the Frezza U.S. Pat. No. 4,053,152, for example, incorporated by reference.

In a practical, commercial-size unit according to the invention, a nozzle unit of about forty-three inches in width was provided for the processing of tubular knitted fabric up to maximum width somewhat less than the nozzle width. Steam was supplied at a pressure of about 80 psi, corresponding to a steam temperature of about 225° F. Under such conditions, the nozzle temperature, in the region of the tip, can be stabilized at about 220°0 F. Steam at the rate of 460 pounds per hour was discharged through a one mil wide (0.001") slot, approximately at sonic velocities. Under the conditions specified, it is possible to remove approximately 1.4 pounds of water from the fabric for each pound of steam consumed, and the fabric processing speed may be controlled accordingly, as a function of the weight of water per pound of dry fabric. By way of comparison, a conventional tensionless dryer, of the type herein described and in common use throughout the industry, utilizes approximately 2.5 pounds of steam to remove a pound of water, as compared to approximately 0.7 pounds of steam per pound of water removed via the nozzle processing procedure of the invention.

Equally important, a typical two drum commercial dryer of known and widely used construction may have a maximum water removal capacity of, say, 350 pounds per hour. Under conventional practices, utilizing roller extraction of the fabric in advance of drying, the incoming fabric to the dryer will contain approximately 85% moisture, such that approximately 410 pounds of dry weight fabric can be processed in an hour's time. By way of comparison, fabric subjected to nozzle processing according to the invention has a liquid content of 50% or less, such that approximately 700 pounds or more of dry weight fabric can be processed in an hour's time. Thus, quite in addition to the obvious energy savings, the fact that a given dryer unit may be almost doubled in capacity allows for significant reduction in captial investment, factory floor space and, perhaps more importantly than either of the foregoing, greatly reduced labor expense.

Another significant advantage derivable from the process and apparatus of the invention is the practical improvement of so-called wet-on-wet foam processing to the point of greater economic viability. In this respect, so-called foam processing of tubular knitted fabrics has certain advantages in enabling the application of dyes and other processing chemicals through a foam medium, rather than more conventional liquid medium, with a resulting reduction in liquid input to the fabric and a concomitant reduction in energy cost in the subsequent drying and/or curing of the foam-processed fabric. For wet-on-wet processing, however, wherein foam-based chemicals are applied to wet processed fabric, the enonomics of foam processing are less evident, at least with conventional extraction procedures. For example, with conventional, roller-expressed wet fabric, containing a moisture level of approximately 85%, the addition of foam-based chemicals will raise the moisture content of the fabric to approximately 95%, as compared to perhaps 105% where the fabric is conventionally processed with liquid-based chemicals followed by roller expression of the execess processing liquid. Thus, under conventional practices, the moisture content of fabric entering the dryer after a wet-on-wet processing operation is a 105% with liquid-based chemical processing versus about 95% with foam-based processing, a difference that frequently does not justify modification of a processing line to utilize foam processing. Where the incoming fabric has been processed by high velocity nozzle techniques according to the invention, however, the incoming moisture level of the fabric is approximately 50% or less, which increases to, say, 60% or less after application of foam-based chemicals. Under these conditions, foam-based application of chemicals in wet-on-wet processing achieves an advantage of 60% or less moisture going into the dryer versus 105% moisture resulting from liquid processing (liquid processing results in 105%, say, independently of the moisture level of the incoming fabric, as will be understood).

The process according to the invention, for the first time enables knitted fabric to be processed by the so-called Mach nozzle technique of the Brugman U.S. Pat. No. 4,137,045. Thus, notwithstanding the general observations in the Brugman patent of its applicability to knitted fabrics, experience prior to this invention led to the conventional wisdom that knitted fabrics could not be effectively processed according to this procedure. Among the innovations of the present invention that make this possible, contrary to conventional wisdom, are the first and second stage spreading of first the wet fabric immediately before and then the damp fabric immediately after, nozzle processing, and the tension control of the wet, geometrically unstable fabric passing over the high velocity nozzle, by independently variable speed control of entry side and exit side rolls, with the exit side rolls being driven at a sufficiently higher rate of speed than the entry side rolls, to maintain tension on the fabric and accommodate the resulting width reduction and length extension of the unstable, wet fabric. The fabric is passed through entry side and exit side roll pairs, without, however, loading either roll pair, and particularly the entry side, for the purpose of expressing liquid from the fabric. Rather, the upper rolls of each pair are relatively lightweight, non-loaded rolls whose function is merely to assist in the frictional engagement of the fabric with the lower, driven rolls of each pair, so as to provide for the necessary tension control of the fabric, without on the other hand undesirably creasing the edges of the fabric.

In one advantageous form of the process according to the invention, the fabric, after being nozzle processed and laterally distended in damp form to desired width, is gathered, as by folding, and subsequently delivered in its gathered form to a suitable dryer. In another form of the invention, the damp fabric, at its state of elevated temperature from the high velocity steam nozzle, is conveyed substantially directly and in a continuous manner into the dryer, such that the dryer can be operated at somewhat increased rates of speed, with a reduction in energy utilization. The last described procedure logically requires, however, a dryer whose nominal speed of operation is consistent with the rate of throughput of the nozzle processing equipment.

The nozzle processing according to the invention also makes highly attractive, for the first time, foam processing of fabric in a wet-on-wet procedure, in which foam-based chemcials are applied to the fabric in its "wet" form, but after reduction of its liquid content by nozzle processing according to the invention. With conventional roll expressing techniques for the reduction of liquid content of the fabric, the advantages of wet-on-wet foam processing are rather minimal, and typically insufficient to justify conversion of the processing line to utilize foam techniques. With nozzle processing according to the invention, however, the reduction in liquid content of the fabric is sufficiently dramatic that very significant advantages can be realized through wet-on-wet foam processing.

The energy savings relalizable through the process and apparatus of the invention are most impressive, such that the recovery of investment in equipment to carry out the new process may be realized in a manner of a fraction of a year. At the same time, since the dryer equipment typically is among the slowest operating units in a line, the entire sequence of processing operations in a plant may be expedited with consequent savings in equipment costs, factory utilization, labor, and the like.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. Apparatus for the processing of wet tubular knitted fabric, which comprises (a) first stage internal spreader means for receiving wet-processed tubular knitted fabric and spreading it to flat form, (b) means for controlling the speed of advance of the incoming wet fabric, (c) a nozzle disposed transversely of the path of fabric movement and on the downstream side of said first stage spreader means, (d) means to supply said nozzle with gaseous drying medium under pressure, (e) said nozzle and said means to supply being so related as to provided for the discharge of drying medium from the nozzle at approximately sonic velocities, (f) means for guiding the fabric around and in contact with said nozzle whereby said drying medium may be discharged through the fabric, (g) said means for guiding including an exit side drive roll engaging the tubular knitted fabric across its width, (h) controllable drive means for driving said first stage spreader and said exit side drive roll, whereby said fabric is elongated and maintained under tension between said first stage spreader and said exit side drive roll, (i) second stage spreader means located downstream of said exit side drive roll for laterally distending the fabric to predetermined width, and (j) means for further processing said fabric.

2. Apparatus according to claim 1, further characterized by (a) said means for guiding further including an entry side drive roll, (b) said controllable drive means being connected to the respective entry side and exit side drive rolls.

3. Apparatus according to claim 2, further characterized by (a) said entry side and exit side drive rolls each comprising the lower rolls of a cooperating roll pair, (b) the respective upper rolls of said pairs being of lightweight construction and being maintained free of external loading whereby to minimize rolling pressure on said fabric.

* * * * *